US006006859A

United States Patent [19]

Hussaini

[11] Patent Number: 6,006,859

[45] Date of Patent: Dec. 28, 1999

[54] MUFFLER EXHAUST TIP

[75] Inventor: Saied Hussaini, Miami, Fla.

[73] Assignee: Rally Manufacturing, Inc., Miami, Fla.

[21] Appl. No.: 09/139,763

[22] Filed: Aug. 25, 1998

[51] Int. Cl.[6] ..... F01N 7/08

[52] U.S. Cl. ..... 181/227

[58] Field of Search ..... 181/227, 228, 181/238, 239, 251, 268, 275

[56] References Cited

U.S. PATENT DOCUMENTS

D. 164,960 3/1951 Russell .
D. 247,360 2/1978 Hamaguchi et al. .
D. 384,319 9/1997 Harutiunian .
3,043,097 7/1962 Inman et al. .
4,354,573 10/1982 Tabata et al. ..... 181/239
4,432,139 2/1984 Baldwin .
4,475,623 10/1984 Gerber et al. .
5,831,223 11/1998 Kesselring ..... 181/227

*Primary Examiner*—Khanh Dang
*Attorney, Agent, or Firm*—Liniak, Berenato, Longacre & White

[57] ABSTRACT

A muffler exhaust tip has a first end provided with clamping members and a second end having a decorative exterior finish. The construction of the muffler tip allows the manufacturer to provide multiple decorative exterior finishes on the muffler tip body. Two adjustable clamping members facilitate attachment of the muffler tip to an exhaust pipe of a motor vehicle. The clamping members attach to the tailpipe of a muffler with a high retention force and can accommodate tailpipes of different diameters for a "universal" fit. A sound amplifying member is set inside the muffler tip, comprising a dual plate member which increases the sound decibel output from the tailpipe and also provides an attractive end cover for the muffler tip.

7 Claims, 4 Drawing Sheets

MUFFLER EXHAUST TIP

BACKGROUND OF THE INVENTION

The invention relates to a decorative and functional item for customizing an automotive vehicle and more particularly to a muffler tip to be attached to the existing tailpipe of a vehicle muffler.

Several types of decorative tailpipes are available to a vehicle owner which attach to the tailpipe of a vehicle muffler. Most common are simply tubular tailpipe covers constructed of chrome or shiny metal which concentrically fit over the end of a muffler tailpipe and are attached to the tailpipe by set screws through screw holes provided in the tubular cover. These tailpipes are useful for decorative purposes to customize a vehicle. Other types of tailpipes extension are available for diffusing exhaust, or for creating a partial vacuum at the outlet of the exhaust system to improve engine efficiency, such as in U.S. Pat. Nos. 3,043,097, 4,323,139, and Des. 247,360.

The invention is both a decorative custom muffler tip, and a functional muffler tip capable of providing higher sound decibel (db) from the existing muffler tailpipe of a vehicle.

An object of the present invention is to provide a unique decorative and functional muffler tip for attachment to the tailpipe of a vehicle muffler tailpipe for the purpose of accessorizing the vehicle according to the preference of the vehicle owner.

Another object of the present invention is to provide a device which can easily be attached to the tailpipe of an exhaust system without the necessity of great expertise, and which functions to increase the sound emitting from the tailpipe.

Still another object of the present invention is to provide a device for attachment to the tailpipe of muffler which has mounting means as part of the device.

A further object of the invention is to provide a universal fit for a muffler tip which can be attached to most tailpipes due to an adjustable mounting means.

A further object of the invention is to provide a construction of the muffler tip which allows the manufacturer to provide multiple decorative exterior finishes on the same device.

These and other objects and features of the invention will be apparent from the following description and appended claims.

SUMMARY OF THE INVENTION

The invention briefly is muffler tip attachment for customizing a vehicle exhaust tailpipe, comprising a substantially tubular body having a first end and a second end, a clamping member attached to the first end of the body for attaching the tubular body at the first end to an outlet end of an exhaust tailpipe in a snug telescopic engagement, and a sound amplifying member attached to the second end of the body for amplifying the sound decibel output from the tailpipe when the muffler exhaust attachment is clamped to the tailpipe.

The second end of the body has a decorative exterior finish. The tubular body is designed such that the first end and the second end are attached by fastening means, so that a manufacturer can attach a plurality of different second ends having a variety of decorative exterior finishes to an equal plurality of identical first ends, thereby reducing manufacturing costs.

The muffler tip clamping members are adjustable to fit multiple tailpipe diameters. The clamping members have a U-shaped bracket with a bracket end positioned on an exterior of the first end, and two bracket legs extending through slots in the first end to an interior of the first end. A threaded screw hole is provided through the first end of the body between the slots. A screw passes through the bracket end and the screw hole from the exterior to the interior, such that the clamping member is adjustable by loosening or tightening of the screw which adjusts the distance which the bracket legs extend into the interior.

The muffler tip is provided with a sound amplifying member comprising a dual plate member disposed across an outlet end of the second end of the tubular body. The dual plate member has an inner member, an outer member, and a central hole through the dual plate member. Further, the inner member and the outer members are both provided with multiple holes which are offset from each other to amplify the sound decibel from the tailpipe.

BRIEF DESCRIPTION OF THE DRAWINGS

The invention will be more fully understood from the following detailed description and appended claims when taken with the drawings in which:

DETAILED DESCRIPTION OF THE INVENTION

Figure 1:
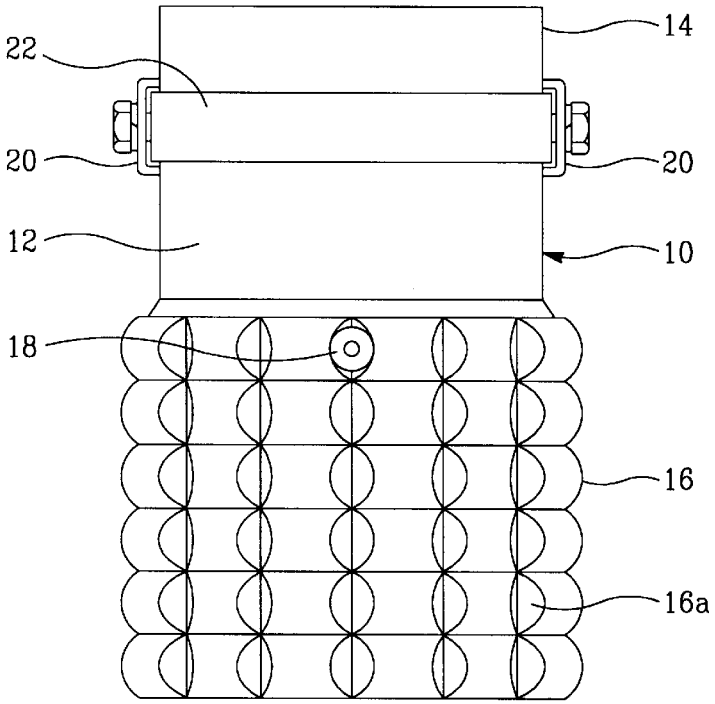
FIG. 1 is a top view of the muffler tip according to the invention.
Figure 2:
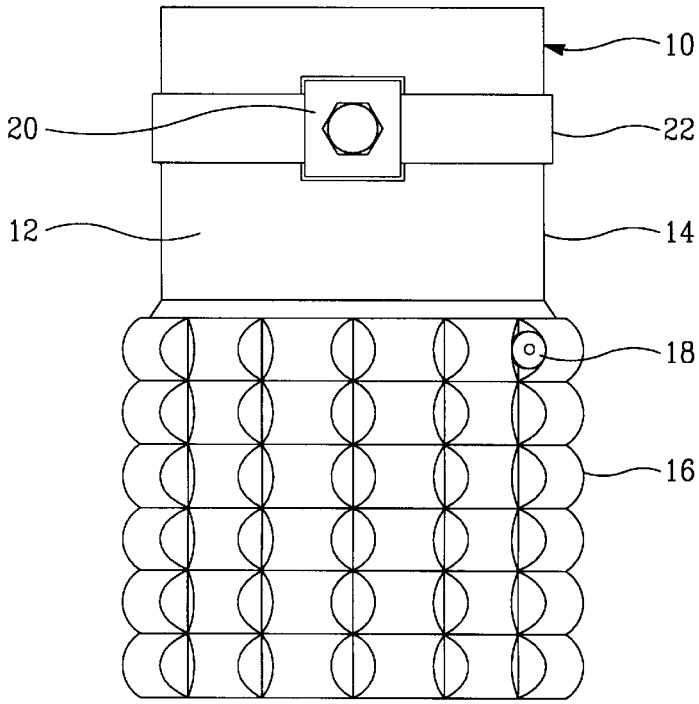
FIG. 2 is another view of the muffler tip of FIG. 1 rotated ninety degrees.

Referring now to FIGS. 1 and 2, the muffler tip 10 has a hollow tubular body 12, comprising a first end 14 and a second end 16. The second end 16 has an inner diameter slightly larger than the outer diameter of the first end 14, such that the two ends fit together in a snug concentric overlapping relationship. The second end 16 is secured to the first end 14 in the overlapping relationship by means of rivets 18 spaced around the tubular body 12. The exterior surface of the second end 16 has a decorative finish 16*a*.

Two adjustable clamping members 20 are provided on opposite sides of the first end 14 to facilitate attachment of the muffler tip 10 to an exhaust pipe of a motor vehicle according to the invention. A reinforcing band 22 surrounds the first end 14 of the muffler tip 10 to add strength to the clamping area of the first end, as the clamping members 20 extend through the tubular first end 14, as will be further described hereinafter.

Figure 3:
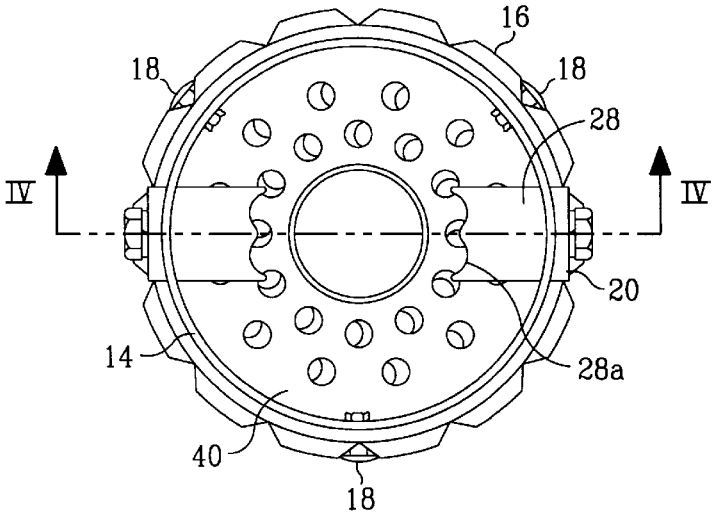
FIG. 3 is an end view of the muffler tip viewing the muffler tip from an inner end which is attachable to an exhaust pipe.
Figure 4:
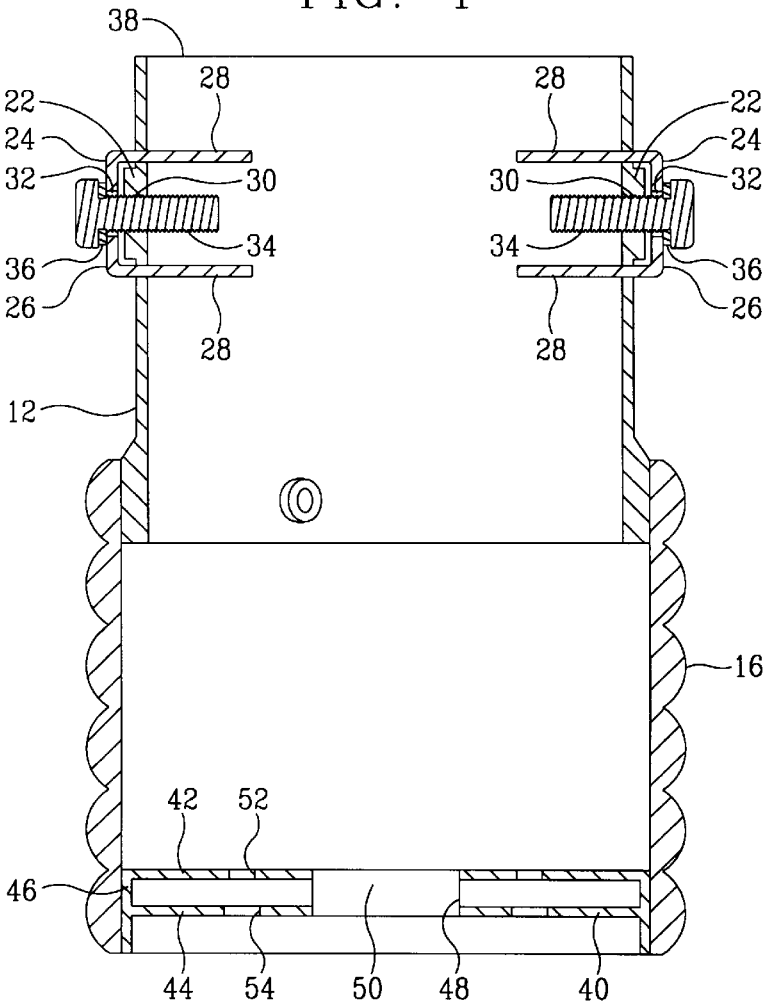
FIG. 4 is a cross section of FIG. 3 taken along line IV—IV which shows the attachment means clearly.
Figure 5:
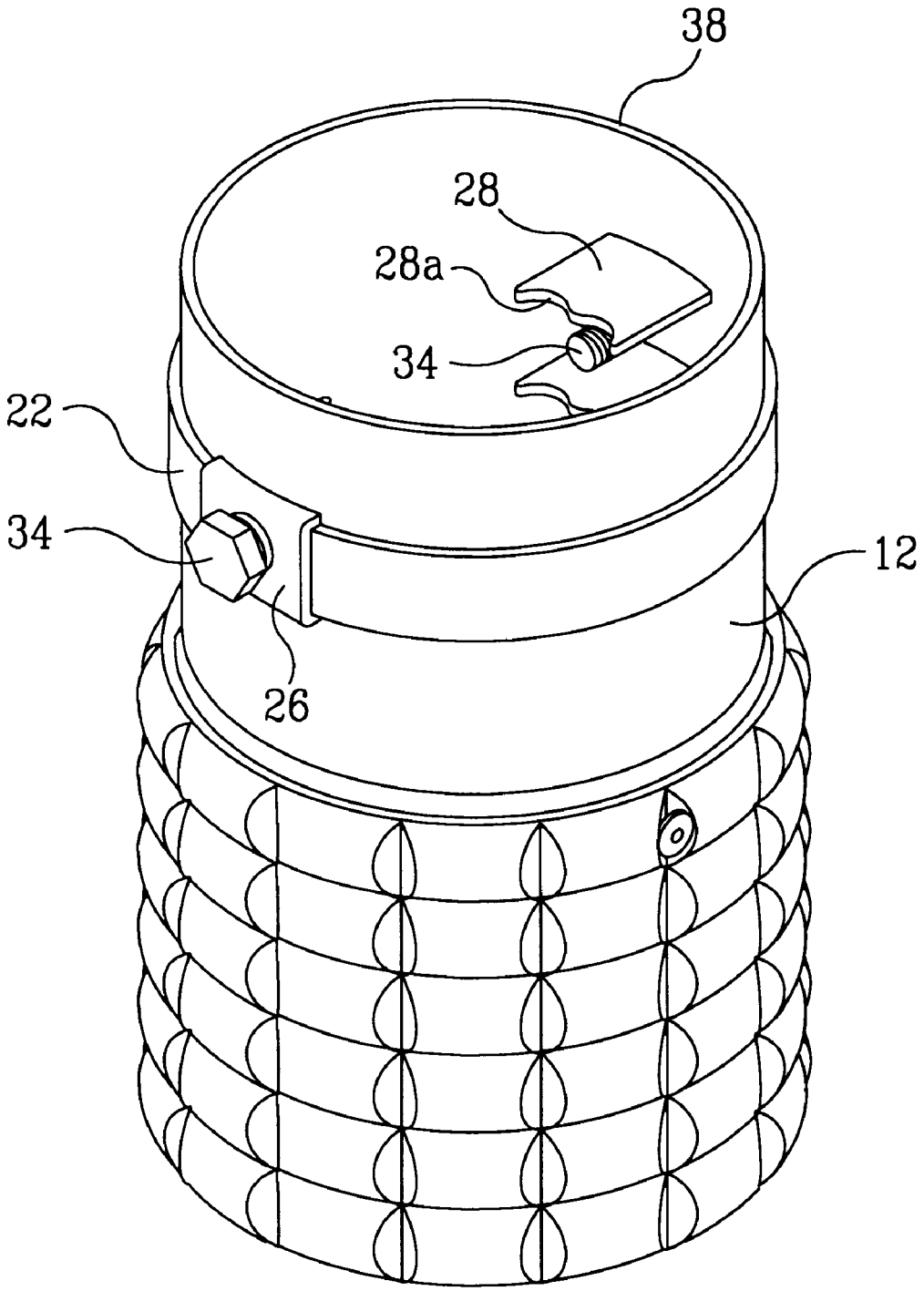
FIG. 5 is an isometric view of the muffler tip in an upright position.

FIGS. 3, 4, and 5 illustrate the clamping members 20 in further detail. The clamping members 20 each have a U-shaped bracket 24 comprising an end 26 and two legs 28. The bracket legs have scalloped edges 28*a* for accommodating various tailpipe diameters and higher contact pressure. The bracket end 26 is positioned on the outside of the body 12 at the reinforcing band 22. The bracket legs 28 extend through slots in the first end on opposite axial sides of the reinforcing band 22 to the inside of the body 12. Threaded screw holes 30 and clearance holes 32 are provided in the band 22 and the bracket ends 26 respectively. Threaded screws 34 pass through the screw holes 30 and clearance hole 32 from the outside of the body 12 into the inside. Lock washers 36 are disposed between the screw heads and the bracket ends 26.

The adjustable clamping members 20 are designed to attach to the tailpipe of a muffler with a high retention force. The clamping members 20 can accommodate tailpipes of different diameters for a "universal" fit. To install the muffler tip 10 onto a tailpipe, the clamping members are adjusted to widen or narrow the distance between the opposed bracket legs 28 by adjustment of the screws 34. The relative distance between the bracket legs 28 is adjustable by loosening or tightening of the screws 34. The screws 34 are first loosened to loosen the clamp brackets 24 to a desired width according to the width of the existing tailpipe on which the muffler tip 10 is to be installed. The open end 38 of the muffler tip is placed over the existing tailpipe, and then the screws 34 are tightened to narrow the distance between the opposed bracket legs 28 and secure the clamping members 20 to the tailpipe. Therefore the muffler tip 10 is adapted for snug and secure telescopic engagement with the outlet end of the exhaust tailpipe.

Figure 6:
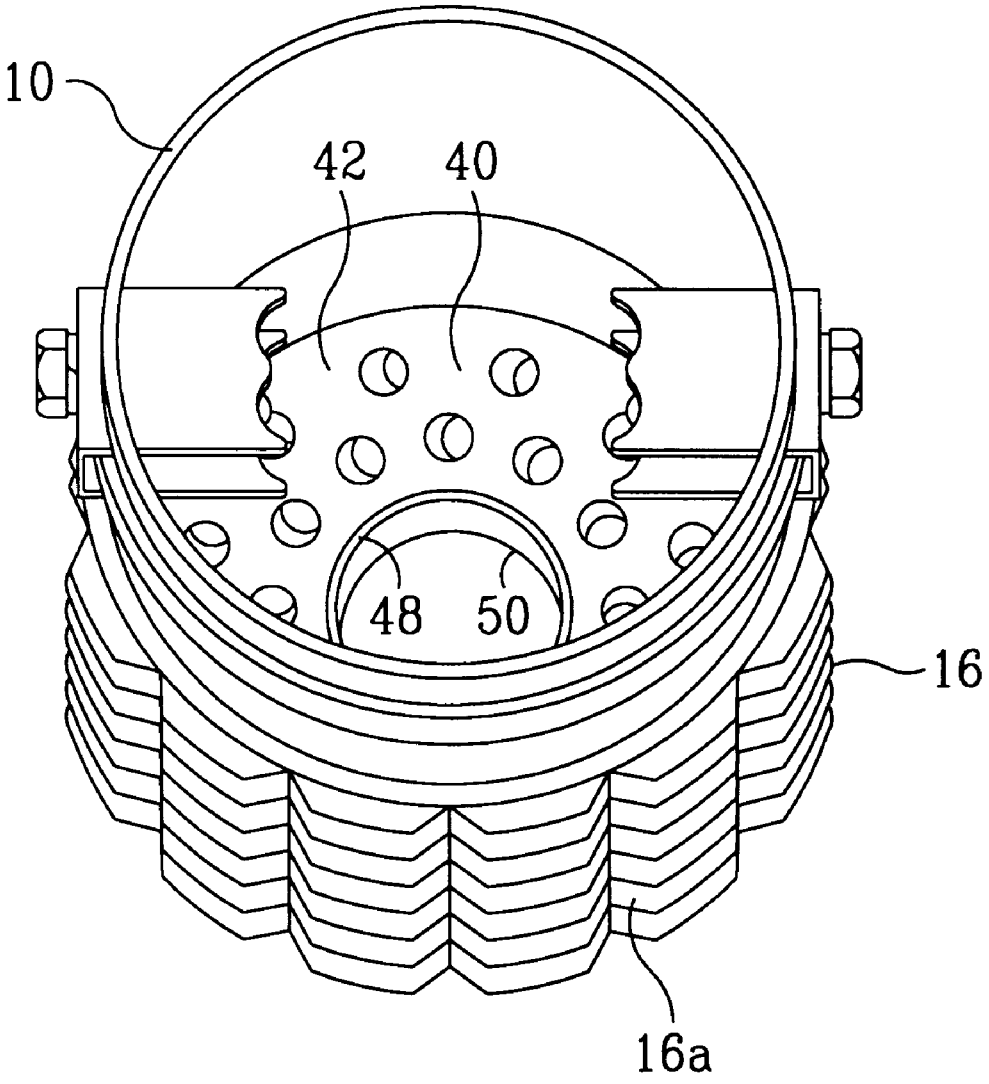
FIG. 6 is a perspective view of the muffler tip according to the invention looking into the tip from the inner end.

Referring now to FIGS. 3, 4, and 6, a functional dual plate member 40 is provided at the outer end of the muffler tip body 12, according to a feature of the invention, to amplify the sound decibel emitted from the tailpipe of an exhaust tailpipe when the muffler tip is attached to the tailpipe. The dual plate member 40 is attached to the inside of the second end 16 and may be fastened by suitable fastening means such as rivets or welding. The dual plate member comprises an inner plate member 42, an outer plate member 44, an outer connecting wall 46, and an inner connecting wall 48 which forms a central hole 50 in the dual plate member 40. The inner and outer plate members 42, 44 are both provided with multiple holes 52, 54, respectively. The plate holes 52 and 54 are offset from each other as best viewed in FIG. 3, so as to amplify the sound decibel from the existing tailpipe. The dual plate member increases the sound decibel output from the tailpipe and also provides an attractive end cover for the muffler tip 10.

The construction of the muffler tip 10 allows the manufacturer to provide multiple decorative exterior finishes on the muffler tip body. The manufacturer need only change the second end 16 of the muffler tip body 12 attaching various decorative finishes 16*a* onto the same first end 14 provided with the adjustable clamping mechanism 20. The decorative finishes can have a smooth or textured finish, and can be chrome, shiny metal, or painted metal to customize the muffler tip to a particular consumer's desire. Other types of finished can also be used to, and the invention is not limited to the exemplary finish described.

While the invention has been described with references to particular embodiments, the description is illustrative and is not to be construed as limiting the scope of the invention. Various modifications and changes may occur to those skilled in the art without departing from the spirit and scope of the invention as defined by the appended claims.

I claim:

1. A muffler tip attachment for customizing a vehicle exhaust tailpipe, comprising:

a substantially tubular body having a first end and a second end;

a clamping means attached to the first end of the body for attaching the tubular body at the first end to an outlet end of an exhaust tailpipe in a snug telescopic engagement; and sound amplifying means attached to the second end of the body for amplifying the sound decibel output from the tailpipe when said muffler exhaust attachment is clamped to the tailpipe, wherein said second end of the body has a decorative exterior finish, and wherein the first end and the second end are attached by fastening means, such that a manufacturer can attach a plurality of different second ends having a variety of decorative exterior finishes to an equal plurality of identical first ends.

2. A muffler tip attachment for customizing a vehicle exhaust tailpipe, comprising:

a substantially tubular body having a first end and a second end;

a clamping means attached to the first end of the body for attaching the tubular body at the first end to an outlet end of an exhaust tailpipe in a snug telescopic engagement; and sound amplifying means attached to the second end of the body for amplifyig the sound decibel output from the tailpipe when said muffler exhaust attachment is clamped to the tailpipe, wherein said clamping means comprises at least one clamping member having a U-shaped bracket with a bracket end positioned on an exterior of the first end and two bracket legs extending through slots in the first end to an interior of the first end, a threaded screw hole through the first end of the body between said slots, a set screw passing through the bracket end and the screw hole from the exterior to the interior, said clamping means being adjustable by loosening or tightening of the screw to adjust a length of the bracket legs extending into the interior.

3. The muffler tip attachment according to claim 2, wherein said clamping means is two clamping members disposed on opposite sides of the first end of the tubular body.

4. A muffler tip attachment for customizing a vehicle exhaust tailpipe, comprising:

a substantially tubular body having a first end and a second end;

a clamping means attached to the first end of the body for attaching the tubular body at the first end to an outlet end of an exhaust tailpipe in a snug telescopic engagement; and sound amplifying means attached to the second end of the body for amplifyng the sound decibel output from the tailpipe when said muffler exhaust attachment is clamped to the tailpipe, wherein said sound amplifying means comprises a dual plate member disposed across an outlet end of the second end of the tubular body, the dual plate member having an inner member, an outer member, and a central hole through the dual plate member, wherein the inner member and the outer members are both provided with multiple holes which are offset from each other to amplify the sound decibel from the tailpipe.

5. A muffler tip attachment for customizing a vehicle exhaust tailpipe, comprising:

a substantially tubular body having a first end and a second end;

a clamping means attached to the first end of the body for attaching the tubular body at the first end to an outlet end of an exhaust tailpipe in a snug telescopic engagement, wherein said clamping means comprises at least one clamping member having a U-shaped bracket with a bracket end positioned on an exterior of the first end and two bracket legs extending through slots in the first end to an interior of the first end, a threaded screw hole through the first end of the body between said slots, a screw passing through the bracket end and the screw hole from the exterior to the interior, said clamping means being adjustable by loosening or tightening of the screw to adjust a length of the bracket legs extending into the interior.

6. The muffler tip attachment according to claim 5, wherein said second end of the body has a decorative exterior finish.

7. The muffler tip attachment according to claim 6, wherein the first end and the second end are attached by fastening means, such that a manufacturer can attach a plurality of different second ends having a variety of decorative exterior finishes to an equal plurality of identical first ends.

* * * * *